United States Patent [19]

Schmidt

[11] Patent Number: 4,671,703

[45] Date of Patent: Jun. 9, 1987

[54] APPARATUS FOR DRIVING PIPES THROUGH THE GROUND

[76] Inventor: Paul Schmidt, Winterberger Strasse, 5940 Lennestadt 14, Fed. Rep. of Germany

[21] Appl. No.: 631,613

[22] Filed: Jul. 17, 1984

[30] Foreign Application Priority Data

Jul. 21, 1983 [DE] Fed. Rep. of Germany ..... 3326246

[51] Int. Cl.[4] ..... E02F 5/18

[52] U.S. Cl. ..... 405/184; 175/62; 405/154

[58] Field of Search ..... 405/184, 154, 138, 140; 175/62; 254/29 R

[56] References Cited

U.S. PATENT DOCUMENTS

| | | | |
|---|---|---|---|
| 1,993,366 | 3/1935 | Englebright | 175/62 X |
| 2,325,565 | 7/1943 | Williams | 405/184 |
| 2,383,496 | 8/1945 | Nebolsine | 405/184 X |
| 3,402,781 | 9/1968 | Sandberg | 175/62 X |
| 3,945,443 | 3/1976 | Baines | 175/62 X |

FOREIGN PATENT DOCUMENTS

| | | | |
|---|---|---|---|
| 657134 | 4/1979 | U.S.S.R. | 405/184 |

*Primary Examiner*—Dennis L. Taylor

*Attorney, Agent, or Firm*—Toren, McGeady, Stanger, Goldberg & Kiel

[57] ABSTRACT

Apparatus for driving an open-ended pipe 7, which has a driving shoe 6 at its leading end, through the ground comprises a driving member 2, 3 to which percussive driving forces are applied by a driving mechanism. Instead of fitting the part 3 of the driving member directly into the rear end of the pipe 7 as is usual an intermediate component 8 is interposed between the pipe and the part 3. The component 8 has soil outlet openings 10 and a deflector 16 to allow soil which enters the pipe 7 through the shoe 6 as driving proceeds to pass through and out of the pipe without stopping the driving. The passage of the soil through the pipe 7 is assisted by water supplied under pressure through a pipe 11 to an annular duct 12 in the shoe 6, when the water flows inwards through nozzles 13 and then rearwards through the pipe 7 carrying the soil with it.

8 Claims, 3 Drawing Figures

APPARATUS FOR DRIVING PIPES THROUGH THE GROUND

This invention relates to apparatus for driving open-ended pipe, for example protective conduits or pipelines, through the ground.

The driving of steel or other metal pipe with the assistance of a pipe driving apparatus having a part-conical head which engages directly or through a driving attachment into the rearward end of the pipe which is guided in the direction of driving on bearing supports and which has a driving shoe which fits internally and externally over its forward end, has become increasingly common. Since the pipe being driven is open at the front, that is at the driving shoe, the soil through which the pipe is driven penetrates during driving further and further into the interior of the pipe, while the driving shoe compacts the soil surrounding the pipe and, because the shoe is of a larger diameter than the pipe, the shoe creates a hole through the ground, in which the pipe moves forwards under the impacts of the driving apparatus with comparatively low external wall friction.

As the pipe becomes filled with soil over an increasing length as driving advances, the soil friction against the internal wall of the pipe also increases. This is particularly so as the soil in the interior of the pipe becomes progressively more compacted under the influence of the driving blows and under the pressure of the soil entering from the forward end of the pipe. Furthermore, the soil situated inside the pipe is inevitably accelerated forwards together with the pipe in the forward movement of the pipe. Because of these factors additional energy is expended in driving the pipe. What is more, as driving proceeds, the soil must from time to time be removed from the inside of the pipe.

A number of techniques are used for removing the soil from the inside of the pipe. Thus, for example, the soil can be removed from the interior of the pipe by means of a driven screw conveyor. It may also be flushed out with high-pressure water, but both these techniques require additional expenditure on apparatus and cause considerable interference with the driving operations. In another technique, which is used when the forward end of the pipe is accessible, as is usually the case, when driving has been completed for removing the soil from the pipe interior, a pushing disc or piston which seals against the internal surface of the pipe wall is inserted into the leading end of the pipe after driving has been completed, and the interior of the pipe in front of the disc or piston is subjected to compressed air, in order to cause the disc to push the soil out of the interior of the pipe as the disc moves rearwardly through the pipe under the influence of the compressed air. This technique is also cumbersome and expensive, and can, moreover, only be carried out in short lengths of pipe with low frictional resistance, having regard to the friction of the soil against the pipe internal wall.

The object of the present invention is to provide apparatus for driving pipes through the ground which, while involving low expenditure on equipment, makes possible continuous driving and continuous and preferably low-frictional removal of soil form the inside of the pipe.

To this end, according to this invention, apparatus for driving an open-ended pipe through the ground, which comprises a driving member and means for applying a driving force to the member, is characterised by an intermediate component, which in operation is interposed between the driving member and the rear end of the pipe being driven, the intermediate component having at least one outlet opening, through which soil, which penetrates into the pipe at the leading end thereof as driving proceeds, leaves the inside of the pipe.

The intermediate component may be integral with the impact head, that is the driving member, or it may be a separate, preferably tubular component. The outlet openings can lead from the end face of the intermediate component, which in operation is in the rear end of the pipe, especially where the intermediate component is solid, for example where it is part of the driving member.

The outlet openings can also extend radially in the case where the intermediate component is tubular. An intermediate component which has an external part-conical surface which fits in the pipe at one end, an internal part-conical surface which receives the driving member at the other end, and the at least one outlet opening extends radially outwards between the part-conical surfaces, has proved especially successful. To facilitate the removal of the soil from within the pipe a guide device which deflects the soil outwards and in the direction of the outlet openings may be disposed in the interior of the pipe or in the intermediate component, when this is tubular.

The outlet openings in the intermediate component permit continuous removal of the soil from the pipe interior. In order to facilitate this and in particular to reduce the friction of the soil on the inner wall of the pipe, a liquid distributor may be disposed at the front end of the pipe being driven. Through this distributor, liquid such as water containing lubricant may be added in metered proportions to the soil entering the pipe interior. By means of this water, the consistency of the soil and thus the soil friction inside the pipe can be reduced virtually as much as required, and the removal of the soil through the pipe interior and through the outlet openings in the intermediate component is considerably facilitated. Depending upon the local conditions, the soil entering into the interior of the pipe may be converted into a pasty or even a liquid state. For each individual case, this is solely a question of the quantity of liquid which is added per unit quantity of soil.

The provision of a driving shoe connected to a liquid supply pipe, which in operation passes through the pipe interior or between the pipe wall and the soil and leads to liquid outlet openings in the shoe, has proved particularly successful. The shoe preferably has liquid outlet openings leading radially inwards to the soil inside the pipe from an annular duct in the shoe. In this manner the entire periphery of the plug of soil in the pipe interior can have liquid added to it and thus at least an outer zone which substantially reduces friction can be created in the soil.

Two examples of apparatus in accordance with the invention will now be described with reference to the accompanying drawings in which.

Figure 1:
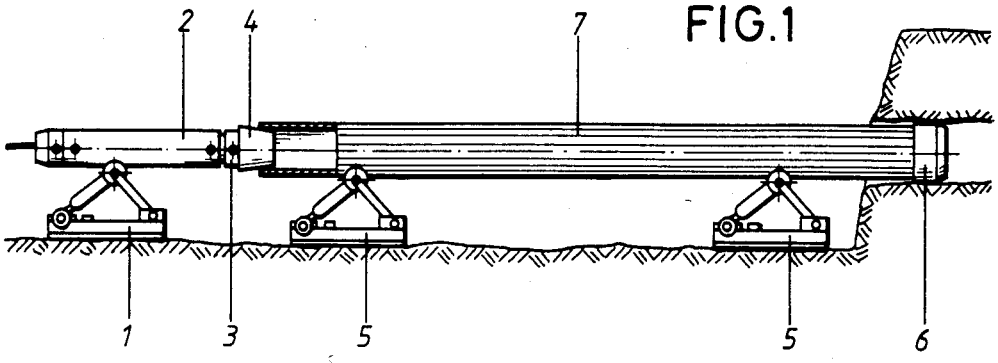
FIG. 1 is a diagrammatical side view of a conventional form of pipe driving apparatus shown driving a pipe.

In horizontal driving of a pipe, a driving apparatus 2 guided on a bearing block 1, has a driving member or impact head 3 engaged via an intermediate component 4 with the rearward end of a pipe 7, which is guided on bearing blocks 5 and has at its forward end a driving shoe 6. The intermediate component 4 is, in the example of FIG. 2, of tubular construction and possesses, at its forward end, an external part-conical surface 8 engaging in the rearward end of the pipe and an internal part-conical surface 9 receiving the impact head 3. Between the outer surface 8 and the internal surface 9 there are outlet openings 10 for the soil situated in the pipe interior. Through one of the outlet openings 10 there extends a liquid supply pipe 11 leading to the driving shoe 6. The shoe has an annular duct 12, with which the pipe 11 communicates and which possesses outlet openings 13.

Figure 2:
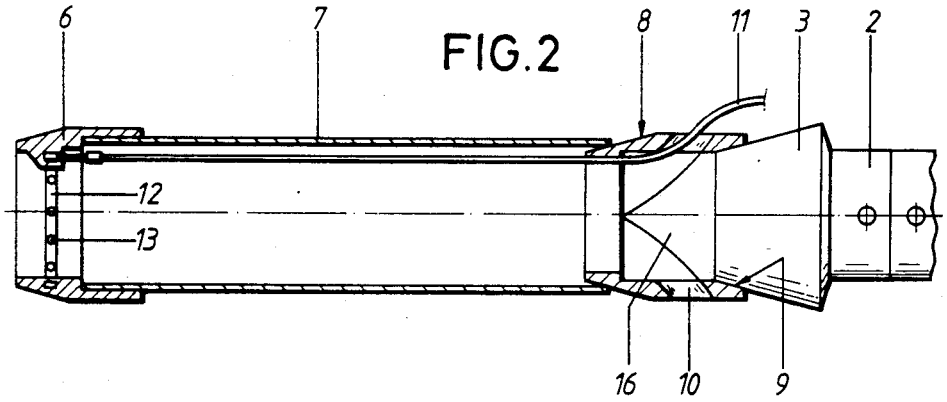
FIG. 2 is a side view to a larger scale of part of an apparatus in accordance with the invention shown fitted to a pipe; and, FIG. 3 is a view similar to FIG. 2, but of another example of an apparatus in accordance with the invention.
Figure 3:
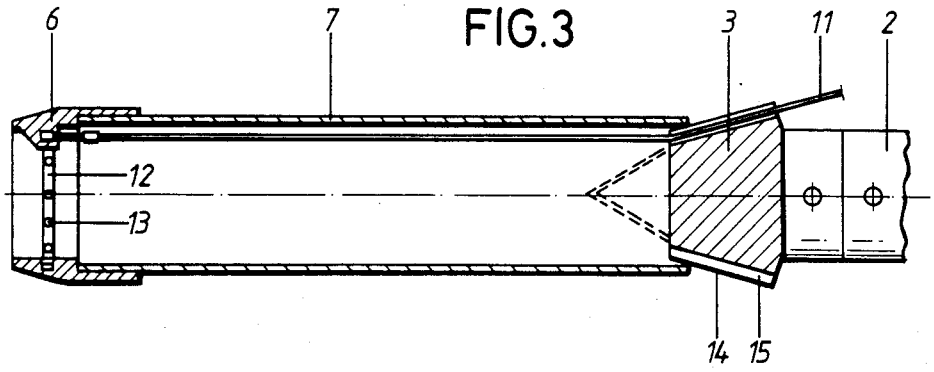

Instead of the tubular intermediate component shown in FIG. 2, a solid intermediate component which may be part of the impact head 3 of the apparatus 2, may be used. This impact head has, as shown in FIG. 3, ribs 14 disposed on its part-conical outer surface in the manner of gear teeth, and outlet ducts 15 are formed between the ribs. These outlet ducts conduct away the soil, which is converted by means of liquid supplied through the pipe 11 to a low-friction mud, outwards out of the pipe interior. One of the ducts also receives the liquid feed pipe 11.

To enable the soil to be conducted away from the pipe interior more effectively, even without liquid flushing, the intermediate component 4 may contain a guide device 16, as shown in FIG. 2. This device deflects the soil from its axial path of movement radially outwards through the outlet openings.

I claim:

1. Apparatus for driving an open-ended, axially extending generally horizontally arranged pipe having a first end and a second end spaced apart in the axial direction where the front end of the pipe is inserted first into the ground and is pushed from the rear end through the ground so that the ground enters the first end of the pipe, comprising means for applying a driving force to the rear end of the pipe, said means including a driving unit having a conically shaped surface extending in the axial direction of the pipe and insertable into contact with the inside surface at the rear end of the pipe so that the driving force is transmitted from the conically shaped surface to the rear end of the pipe, said driving unit having at least one outlet opening with a first end open to the interior of the pipe and a second end open to the exterior of the driving unit whereby the ground displaced into the inside of the pipe as the second end thereof is driven into the ground can be discharged through said at least one outlet opening to the exterior of said driving unit.

2. Apparatus as claimed in claim 1, wherein said driving unit comprises a tubular intermediate component with said conically shaped surface formed on the outer surface thereof.

3. Apparatus as claimed in claim 1, further comprising means for supplying liquid to the front end of said pipe to wash soil entering said front end of said pipe through said pipe and out of said at least one outlet opening.

4. Apparatus as claimed in claim 3, in which said means for supplying liquid comprises a tubular driving shoe for fitting to the front end of said pipe, means defining liquid outlet openings in said shoe, and a liquid supply pipe which, in operation, extends through said pipe from the rear end thereof and communicates with said liquid outlet openings.

5. Apparatus as claimed in claim 4 in which said shoe includes means defining an annular duct therein, and said liquid outlet openings extend radially inwards from said annular duct.

6. Apparatus as claimed in claim 2, in which said intermediate component includes means defining a front face which, in operation, is located in said rear end of said pipe, and said at least one outlet opening leads from said front end face rearwardly and outwardly of said component.

7. Apparatus as claimed in claim 2, in which said driving unit includes a driving member, said intermediate component includes at one end thereof means defining an external part-conical surface forming said conically shaped surface which fits in said rear end of said pipe, means at the other end thereof defining an internal part-conical surface which receives said driving member, and said at least one outlet opening extends radially between said external and said internal part-conical surfaces.

8. Apparatus as claimed in claim 2, in which said intermediate component includes a guide device located therein for deflecting soil in the interior of said pipe radially outwards through said at least one outlet opening.

* * * * *